US007156738B2

(12) United States Patent
Rowe

(10) Patent No.: US 7,156,738 B2
(45) Date of Patent: Jan. 2, 2007

(54) CASINO GAMBLING MACHINE WITH BONUS ROUND AWARD REDEMPTION

(75) Inventor: Richard E. Rowe, Reno, NV (US)

(73) Assignee: IGT, Reno, NV (US)

( * ) Notice: Subject to any disclaimer, the term of this patent is extended or adjusted under 35 U.S.C. 154(b) by 54 days.

(21) Appl. No.: 09/761,031

(22) Filed: Jan. 16, 2001

(65) Prior Publication Data

US 2002/0107065 A1 Aug. 8, 2002

(51) Int. Cl.
*G06F 17/00* (2006.01)
*G06F 19/00* (2006.01)

(52) U.S. Cl. ..... 463/25; 463/16; 463/17; 463/18; 463/19; 463/20; 463/29; 463/42; 463/46; 273/138.1; 273/138.2; 273/139; 273/143 R; 273/269; 283/903

(58) Field of Classification Search ..... 463/1, 463/16–20, 25–29, 40–43, 46; 273/138.1, 273/138.2, 139, 143 R, 269; 902/23; 194/205, 194/353; 283/903

See application file for complete search history.

(56) References Cited

U.S. PATENT DOCUMENTS 5,067,712 A * 11/1991 Georgilas ..... 463/21
5,286,062 A 2/1994 Greenwood et al. ..... 283/106
5,609,337 A 3/1997 Clapper, Jr. ..... 273/138.2
5,722,891 A * 3/1998 Inoue ..... 463/20
5,935,000 A 8/1999 Sanchez, III et al. ..... 463/17
5,941,771 A 8/1999 Haste, III ..... 463/17
5,943,241 A 8/1999 Nichols et al. ..... 364/479.02
5,949,042 A 9/1999 Dietz, II et al. ..... 235/375
5,980,385 A 11/1999 Clapper, Jr. ..... 463/17
6,012,832 A 1/2000 Saunders et al. ..... 364/410
6,048,269 A * 4/2000 Burns et al. ..... 463/25

(Continued)

FOREIGN PATENT DOCUMENTS

EP 0281402 A2 * 7/1988

(Continued)

OTHER PUBLICATIONS

International Search Report, International Application No. PCT/US02/03083, mailed Apr. 22, 2003.

(Continued)

*Primary Examiner*—Scott Jones
*Assistant Examiner*—Milap Shah
(74) *Attorney, Agent, or Firm*—Marshall, Gerstein & Borun LLP

(57) ABSTRACT

An electronic gambling unit for allowing a user to play a main gambling game and a bonus round game, and for dispensing value to the user at the conclusion of the bonus round game, may generally include a display unit capable of generating color images or other display mechanism capable of displaying symbols associated with the main gambling game and the bonus round game. The electronic gambling unit may further include an input device that allows the user to make a plurality of input selections, a currency-accepting mechanism capable of allowing the user to deposit a medium of currency, a value-dispensing mechanism capable of dispensing value to the user, and a controller operatively coupled to the display unit, the input device, the currency-accepting mechanism, and the value-dispensing mechanism. The controller may include a processor and a memory operatively coupled to the processor.

54 Claims, 10 Drawing Sheets

U.S. PATENT DOCUMENTS

| | | | | |
|---|---|---|---|---|
| 6,089,975 | A | 7/2000 | Dunn | 463/16 |
| 6,089,976 | A | 7/2000 | Schneider et al. | 463/16 |
| 6,110,041 | A * | 8/2000 | Walker et al. | 463/20 |
| 6,113,098 | A * | 9/2000 | Adams | 273/138.1 |
| 6,159,098 | A * | 12/2000 | Slomiany et al. | 273/139 |
| 6,162,122 | A | 12/2000 | Acres et al. | 463/29 |
| 6,231,442 | B1 | 5/2001 | Mayeroff | 463/20 |
| 6,257,979 | B1 * | 7/2001 | Walker et al. | 463/13 |
| 6,302,793 | B1 * | 10/2001 | Fertitta et al. | 463/25 |
| 6,315,663 | B1 * | 11/2001 | Sakamoto | 273/143 R |
| 6,340,331 | B1 * | 1/2002 | Saunders et al. | 235/380 |
| 6,347,996 | B1 * | 2/2002 | Gilmore et al. | 273/139 |
| 6,537,151 | B1 * | 3/2003 | Walker et al. | 463/25 |

FOREIGN PATENT DOCUMENTS

| | | |
|---|---|---|
| EP | 1 063 622 | 12/2000 |
| WO | WO 98/47113 | 10/1998 |

OTHER PUBLICATIONS

European Patent Office Communication for European Patent Application No. 02 707 681.9-2221 dated Oct. 12, 2004.

* cited by examiner

CASINO GAMBLING MACHINE WITH BONUS ROUND AWARD REDEMPTION

TECHNICAL FIELD

This invention relates to casino game playing services for gambling units such as slot machines and video poker machines and, more particularly, to methods of redeeming accumulated credits after the completion of a bonus game on a gambling unit.

BACKGROUND ART

Gaming machines generally allow a user to play a main game specific to the gaming machine and then enter a bonus round to win extra game credits or game tokens. Generally, the bonus round is triggered by an event occurring during the main game. Once into the bonus round, the user engages in a bonus game to win the extra credits or tokens. Generally, a user is not given prizes separately in the bonus round, but transferred back into the main game upon completion of the bonus game. The extra game credits or game tokens are added on to the main game total and given to the user at the end of the main game.

There are a number of prior art devices that distribute prizes other than game tokens or game credits. For instance, one category of prior art devices includes automated games of chance where the machine dispenses a pull-tab ticket. For example, U.S. Pat. No. 5,980,385 to Clapper, Jr. discloses an electronic apparatus for dispensing pull-tab tickets containing game scoring indicia. If the ticket is a winning ticket, than the user may redeem it for a number of prizes including cash. This type of device is designed to allow for game play in jurisdictions where typical gaming machines are not allowed. Another type of prior art device disclosed in U.S. Pat. No. 5,949,042 to Dietz, II et al. is designed to look like a conventional gaming machine such as a slot machine. The machine is not real gaming machine, however. The machine presents a typical three-by-three matrix display of symbols similar to conventional slot machines, but the display is not randomly generated. Instead the display imitates the pattern of a pull-tab coupon that is dispensed from the machine each time the machine is played. Finally, other prior art, such as that disclosed in U.S. Pat. No. 5,935,000 to Sanchez, III et al., emphasizes device that are designed to provide a high level of security on conventional gaming ticket dispensing machines. These machines only dispense gaming tickets, and do not provide gaming tickets according to game play. The security is achieved by using different manners of coding on the gaming tickets that may be redeemed at other locations.

SUMMARY OF THE INVENTION

According to one aspect, the present invention may be embodied in an electronic gambling unit for allowing a user to play a main gambling game and a bonus round game, and for dispensing value to the user at the conclusion of the bonus round game. Such an electronic gambling unit may include a display unit capable of generating color images or other display mechanism capable of displaying symbols associated with the main gambling game and the bonus round game. The electronic gambling unit may further include an input device that allows the user to make a plurality of input selections, a currency-accepting mechanism capable of allowing the user to deposit a medium of currency, a value-dispensing mechanism capable of dispensing value to the user, and a controller operatively coupled to the display unit, the input device, the currency-accepting mechanism, and the value-dispensing mechanism. The controller may include a processor and a memory operatively coupled to the processor.

The controller may be programmed to allow the user to make a wager via the input device after the currency-accepting mechanism detects the deposit of currency by the user, and cause a first sequence of images representing the main gambling game to be generated on the display unit after the user makes a wager. The controller may be further programmed to determine the outcome of the main gambling game and a currency payout associated with the outcome, and to determine the occurrence of triggering event causing entry into the bonus round game. The controller may be further programmed to cause a second sequence of images representing the bonus round game to be generated on the display unit, to determine the outcome of the bonus round game and the bonus payout associated with the outcome of the bonus round game, to cause the value-dispensing mechanism to dispense value to the user after the bonus payout is determined, and to return to the main game at the conclusion of the bonus round game.

The value-dispensing mechanism may be capable of dispensing any suitable objects that may be representative of some monetary value, such as paper currency, coins, tokens, gaming machine credit, tickets for shows, meals, casino service, hotel services, and the like. For example, the value-dispensing mechanism may be a printing apparatus capable of printing an award ticket and the award ticket may be printed and dispensed after the bonus award is determined automatically or based on information that may be acquired from selections made by the user at the input device or on information obtained from a player tracking system via a player tracking interface that may be included in the electronic gambling unit. Alternatively, the value-dispensing mechanism may be capable of dispensing value by incrementing value on an item having data stored thereon or value maintained in a player tracking system.

According to another aspect, the present invention may be embodied in a method of dispensing bonus awards to a user at the conclusion of a bonus round game of an electronic gambling unit that allows the user to play a main gambling game and a bonus round game. Such a method may include accepting and detecting a deposit of currency by the user, allowing the user to make a wager of the deposited currency via an input device, and displaying a first sequence of symbols representing the main gambling game on a display mechanism after the user makes a wager. The method may further include determining an outcome of the main gambling game and a currency payout associated with the outcome of the first gambling game, detecting the occurrence of a triggering event during execution of the main gambling game, and displaying a second sequence of symbols representing the bonus round game after detecting the triggering event. Still further, the method may include determining the outcome of the bonus round game and a bonus payout associated with the outcome of the bonus round game, dispensing value to the user via a value-dispensing mechanism after determining the bonus payout, and returning to the main gambling game at the conclusion of the bonus round game.

These and other features of the present invention will be apparent to those of ordinary skill in the art in view of the description of the preferred embodiments, which is made with reference to the drawings, a brief description of which is provided below.

DESCRIPTION OF THE EMBODIMENTS

Figure 1:
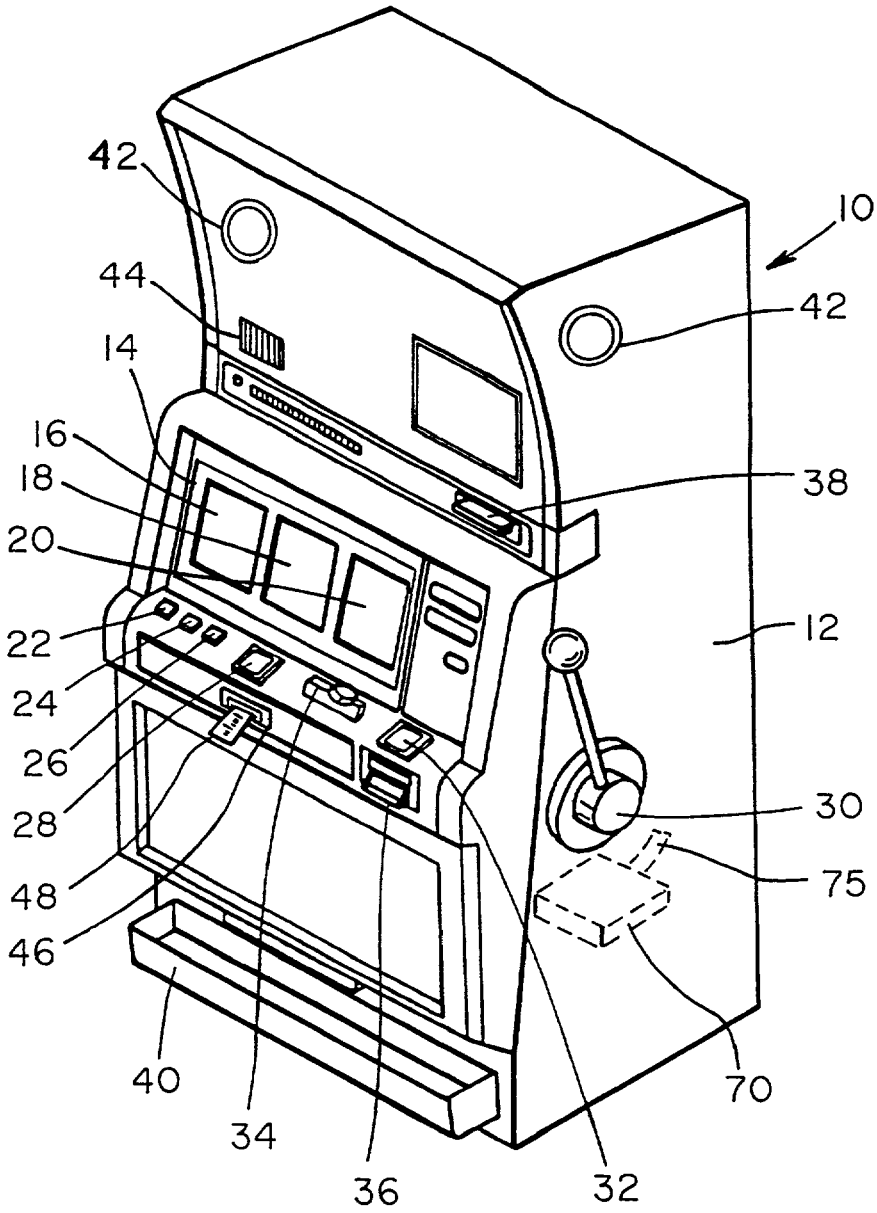
FIG. 1 is an exemplary illustration, partially in section, of a side view of an electronic gambling unit designed in accordance with the teachings of the present invention.

Turning now to the figures, as shown in FIG. 1, a casino gambling unit 10, such as a slot machine or any other like apparatus, may generally include a cabinet 12 which generally surrounds the machine interior (not shown) and is viewable by users. The gambling unit 10 may further include a display unit 14 disposed on the front of the cabinet 12 for displaying graphics and information associated with the video gambling game or games that the user may play at the gambling unit 10. For example, the display unit 14 may display graphics for, inter alia, a plurality of reels 16–20 on a gambling unit 10 configured for the user to play video slots. The display unit 14 may be a color display unit, a monochrome display or any other suitable display. Further, the display unit 14 may be embodied in a cathode ray tube (CRT) monitor, a plasma display, a liquid crystal display (LCD) or any other suitable display technology. For example, the display unit 14 may be embodied in a Multisync LCD Model 1810 available from NEC Technologies. The gambling unit 10 may also include a number of buttons 22–28 that a user may actuate to make bets or wagers, and game-specific selections such as holding or discarding cards, and a handle or arm 30, a spin button 32, or any other type of input device.

The configuration of the gambling unit 10 of FIG. 1 is exemplary, an in no way limiting as to the types of gambling units contemplated for use with the method and apparatus of the present invention. For example, the display unit 14 may display graphics of dealt cards or configurations of numbers for other video gambling games such as video poker, video blackjack, video keno and the like. Still further, the gambling unit 10 may be a traditional slot machine having mechanical reels instead of the display unit 14 and still have application with the method and apparatus of the present invention. Additionally, one or more of the arm 30 and buttons 22–28 and 32 on the gambling unit 10 may be replaced by other types of input devices that are known in the art. For example, the display unit 14 described above may have a touch-sensitive device installed thereon. Such a touch screen may be available from MicroTouch or any other suitable vendor. Other combinations and configurations of mechanical and electronic displays, and input and activation devices will be apparent to those skilled in that art and are contemplated for use with the present invention.

Figure 2:
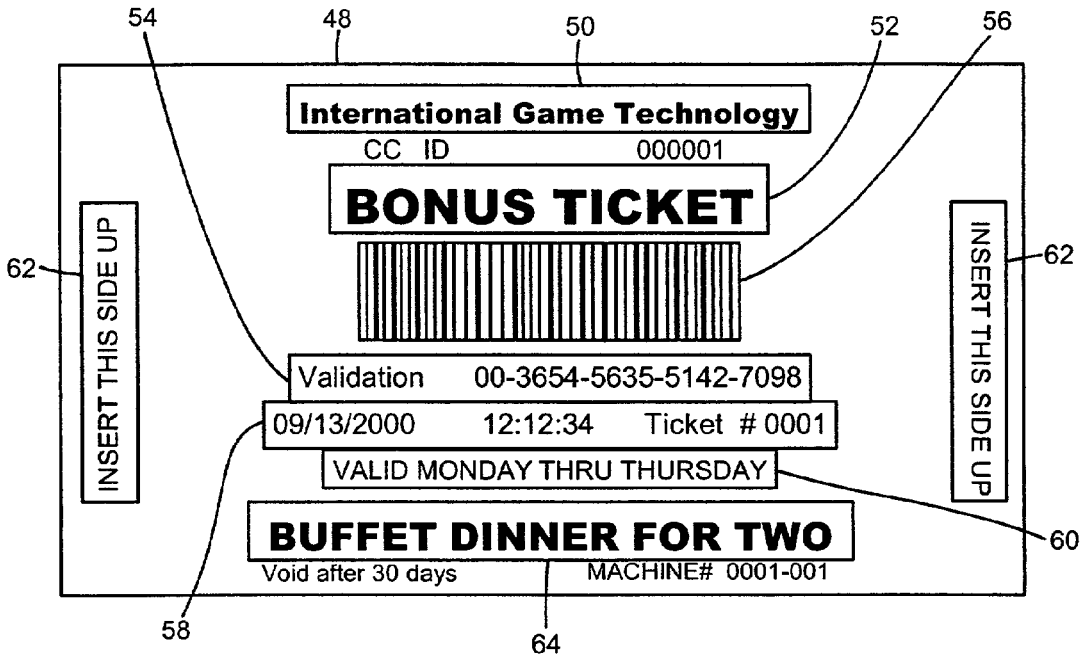
FIG. 2 is an exemplary illustration of an award ticket that may be printed and dispensed by the gambling unit of FIG. 1.

Currency accepting mechanism 34–38 may be disposed on the front of the gambling unit 10 or in any other suitable location. The currency accepting mechanisms 36–40 may be embodied in any device that can accept value from the user. As used herein the term "value" is intended to encompass conventional tokens, coin or bill currency or any other suitable objects that may be representative of some monetary value. Furthermore, as used herein the term value may include cards having value associated therewith (e.g., printed cards, smart cards or the like). For example, slot 34 may accept coins or tokens, bill acceptor 36 may accept and validate bill currency, and card reader 38 may accept coupons, printed cards, smart cards or any other suitable electronic currency that is accepted by the casino. By way of a particular example, the bill validator 36 may be a validator that is commercially available from Japanese Coin Mechanisms (JCM) under model number WBA-12-SS. As shown in FIG. 2, the currency accepting mechanism may be coupled to, and controlled by, a controller 70. When a user deposits value into the currency accepting mechanisms 34–38, a representation of the value that the user has may be displayed to the user on the display unit 14 or on some other display disposed on the cabinet 12. Additionally, a currency accepting mechanism such as the card reader 38, upon receiving a smart card or player tracking card, may interface with a player tracking system to which the gambling unit 10 is connected to acquire user profile, preference and credit information for the user for use by the gambling unit 10 in a manner described more fully below. As the user plays various video gambling games, the value may be incremented as the user wins and may be decremented as the user loses.

The gambling unit 10 may include additional features to enhance the users game playing experience, such as audio speakers 42 and an aroma dispenser 44. The audio speakers 42, which may be embodied in speakers that are commercially available from Boston Acoustics under model number $CX9^3$, or may be embodied in any other suitable speakers, cooperate with a sound generator (not shown) to provide various forms of audio that are relevant to the video gambling game that the user is playing. For example, the sound generator, which may be any suitable and known audio generating circuit, may generate signals representing sounds such as the noise of spinning slot machine reels, a dealers voice, music, announcements or any other suitable audio related to a video gambling game. The aroma dispenser 44, which may be mounted above the display unit 14 or may be mounted in any other suitable location on the gambling unit 10, may be manufactured by MicroScent or DigiScents.

A printer 46 may also be disposed on the front of the gambling unit 10 or in any other suitable location. One exemplary printer 46 is available from SEIKO Instruments USA, Inc. under model number PSA-66-000N. The printer 46, which may be responsive to a controller, may be used for printing tickets 48 reflecting the winnings accumulated by a user. For example, when a user desires to cash out, the printer 46 may print a ticket 48 having the number of user credits printed thereon. The user may then redeem the printed ticket 48 for cash, a check or credit at a casino facility. Alternatively, if the electronic gambling unit 10 is used for lottery purposes, the printed ticket may be redeemed at a lottery facility. Still further, the printed ticket 48 may prepare and dispense unique tickets, such as the sample ticket 48 illustrated in FIG. 2, for awards based on the user's performance during game play, award elections made by the user, information about the user provided by a smart card or player tracking system, and the like. Among other features, the printer 46 may print information on the ticket 48 such as the casino name 50, the type of ticket 52, a validation number 54 and associated bar code 56 with control and security information, the date and time of issuance 58, redemption instructions 60 and restrictions 62, a description of the award 64, and any other information that may be necessary to implement the award ticket system. An example of an award ticket system producing unique award tickets is the EZ Pay Ticket System by International Gaming Technology of Las Vegas, Nev.

During typical use of the gambling unit 10, a user inserts into the gambling unit 10 value that the user may bet. For example, a user may deposit tokens or coins via the slot 34, may insert a card having information representative of value into the card acceptor 38 or may insert a monetary bill into the bill acceptor 36. The following description refers to value being inserted into and dispensed from the gambling unit 10. Once the gambling unit 10 recognizes that the user has deposited value, the user may make a wager using the buttons 22–28, which may allow the user to wager various units of value on the outcome of the game. After making a wager, the user begins a game either by pulling the arm 30 or by actuating the spin button 32, either of which causes the gambling unit to graphically spin the reels 16–20 for a period of time.

As the reels 16–20 spin the gambling unit 10 determines the outcome of the game and stops the reels 16–20 from spinning according to the determined outcome of the game. As the reels 16–20 are stopped, symbols representative of the game outcome, which are disposed on the periphery of the reels 16–20, are displayed to the user. If the gambling unit 10 determines that the outcome of the game is a "winner," a winning combination of symbols is displayed to the user and the gambling unit 10 pays out either by dispensing value to the user or by incrementing the number of credits available to the user to wager on the game. The concept of dispensing value may include dropping tokens into a payout tray 40, adding value to a card placed in the card acceptor 38, printing and dispensing an award ticket 48 from the printer 46, accumulating value for the user within the gambling unit 10 or any other suitable technique of distributing value to a user. If the outcome of the game is a winner, the game ends after the gambling unit 10 pays out. However, if the outcome of the game is not a winner, the combination of symbols displayed to the user is not a winning combination, the gambling unit 10 does not pay out and the game simply ends with the user losing the wagered value.

A game controller 70 may be disposed within the cabinet 12 of the electronic gambling unit 10. The game controller 70 may be coupled to the display unit 14, the audio speakers 42, and the aroma dispenser 44 via a cabling harness (or bus) 75 running through the interior of the cabinet 12. The game controller 70 may be embodied in hardware that is commercially available in, for example, the International Game Technology "Game King" platform for video gambling machines. The game controller 70 may be embodied in a 16 or 32 bit, 16 megahertz (MHZ) 80C960SA microcontroller, which is commercially available from Intel, or may be embodied in any other suitable microcontroller. As shown in detail in FIG. 3, the game controller 70 may include a processor 80 that is communicatively coupled to both of a memory 82 and an input/output circuit 84, via a bus 86. The memory 82 of the game controller 70 may be random access memory (RAM), read only memory (ROM), such as a semiconductor ROM, or any suitable combination thereof. Alternatively or additionally, an additional program memory 83 may be communicatively coupled to the game controller 70 via the bus 86. For example, a memory such as any one, or any suitable combination, of an electrically erasable programmable read only memory (EEPROM), a one time programmable electrically programmable read only memory (OTP EPROM), a static random access memory (SRAM), FLASH or any other suitable memory element may be externally connected to the microcontroller. Furthermore, the memory(ies) may be embodied in other computer-readable media such as optical media, e.g., CDs, rewritable CDs, DVDs and the like, or magnetic media, e.g., floppy disks, hard drives, zip disks and the like. Further detail regarding the functionality of the game controller 70 is described hereinafter with respect to FIGS. 4–11.

As previously mentioned, the controller 70 may be coupled to the electrical components of the gambling unit 10 as described in relation to FIG. 1 via bus 75. In addition, the gambling unit 10 may be connected, along with other gambling units, to a player tracking system via a player tracking interface 88. The player tracking interface 88 may facilitate the exchange of player tracking information for the user between the controller 70 and a central repository. For example, when a user inserts a smart card or player tracking card in the card acceptor 38, the controller 70 may issue a request through the player tracking interface 88 for user preference information such as whether the user prefers to be paid in tokens, tracking system credit, award tickets for cash, credit, goods and services, and the like, and whether the user prefers payout of bonus awards at the conclusion of bonus play.

Referring now to FIGS. 4, 5, 7, 9, and 11, a number of routines are shown that are illustrated using blocks, which represent functions that may be embodied in software instructions stored in the memory 82 (FIG. 3) and carried out by the processor 80. The instructions may be written in any suitable high level language such as, for example, any suitable version of C, C+, C++ or the like. Alternatively, instructions for implementing the functional blocks may be written in any suitable assembly or machine level language.

Figure 4:
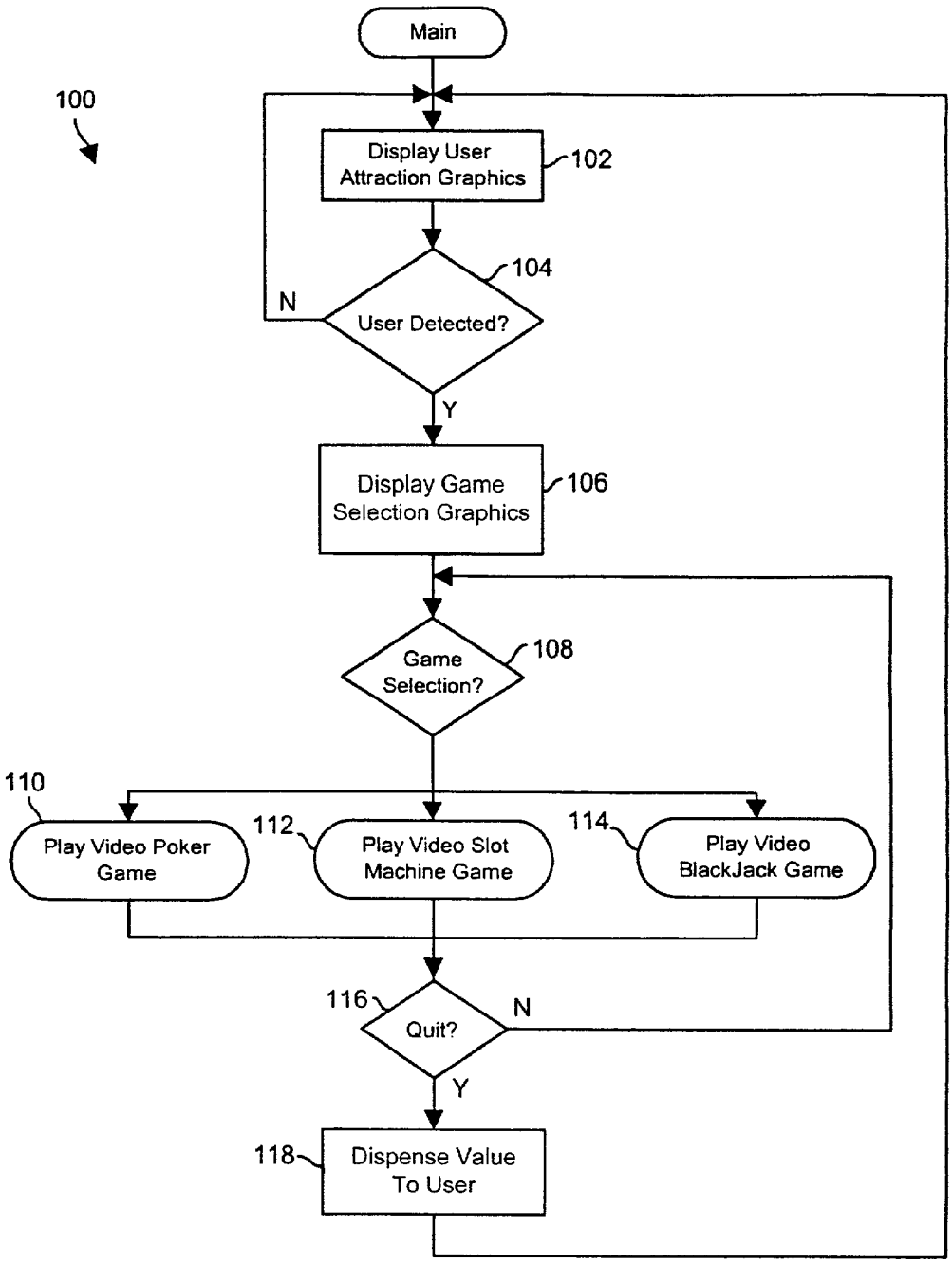
FIG. 4 is an exemplary flow diagram of a main control routine that may be implemented by the controller of FIG. 3.

As shown in FIG. 4, a main routine 100 may begin execution at a block 102 at which user attraction graphics may be displayed on the display unit 14. User attraction graphics may include a scrolling list of games that may be played on the electronic gambling unit 10, cartoons, videos, etc. While graphics are being displayed, a block 104 intermittently checks to see if a user is detected. Such a function may be carried out by, for example, polling the currency accepting mechanisms 34–38 or the touch-sensitive input device. Alternatively, the currency accepting mechanisms 34–38 and touch-sensitive devices may be configured to notify the controller 70 when valid currency is inserted or user contact is detected, respectively. As long as no user is detected, control passes from the block 104 back to the block 102. If, however, the block 104 determines that a user is present, control passes to a block 106.

The execution of the block 106 causes the display of a game selection graphic to the user. The game selection graphic may include a list of video gambling games that may be played on the electronic gambling unit 10. Additionally, at the block 106, the user may be prompted to deposit value into the electronic gambling unit, via the currency accepting mechanisms 34–38. The execution of the routine 100 may not proceed past the block 106 until the user deposits at least the minimum value required for the gambling unit 10. Any value that the user deposits will be stored as credit.

After the block 106 displays the list of available video gambling games to the user, a block 108 detects which game has been selected and branches control to one of subroutines 110–114, each of which represents a particular video gambling game. It should be noted that although three subroutines are shown in FIG. 4, more, fewer or different subroutines representing more, fewer or different video gambling games may be used. For example, a game such as slots with mechanical wheels will forego the game selection block 108 and proceed directly to playing the mechanical slot machine game. Accordingly, more, fewer or different video gambling games may be present on any given electronic gambling unit 10. The description of the subroutines 110–114 is undertaken with respect to FIGS. 5, 7 and 9 after the remaining blocks of FIG. 4 are described.

After one of the subroutines 110–114 have been executed, control passes to a block 116, which queries whether the user has expressed a desire to stop playing the electronic gambling unit 10. The user may express such a desire by selecting a quit graphic displayed on the display unit 14 or through any other suitable manner that informs the game controller 70 of the user's desire to stop playing the electronic gambling unit 10. If the user does not desire to quit, control passes from the block 116 back to the block 108 so that the user may select another video gambling game to play. If, however, the user desires to quit, control passes from the block 16 to a block 118, which cashes out the user by dispensing coins, tokens or currency, dispensing tickets or coupons, either pre-printed or printed by the printer 46, adding value to the user's smart card or player tracking profile, or otherwise reward the user for credits accumulated while playing the gambling unit 10. After the block 118 has completed execution, control passes back to the block 102, at which time the electronic gambling unit 10 again displays graphics to attract another user.

Figure 5:
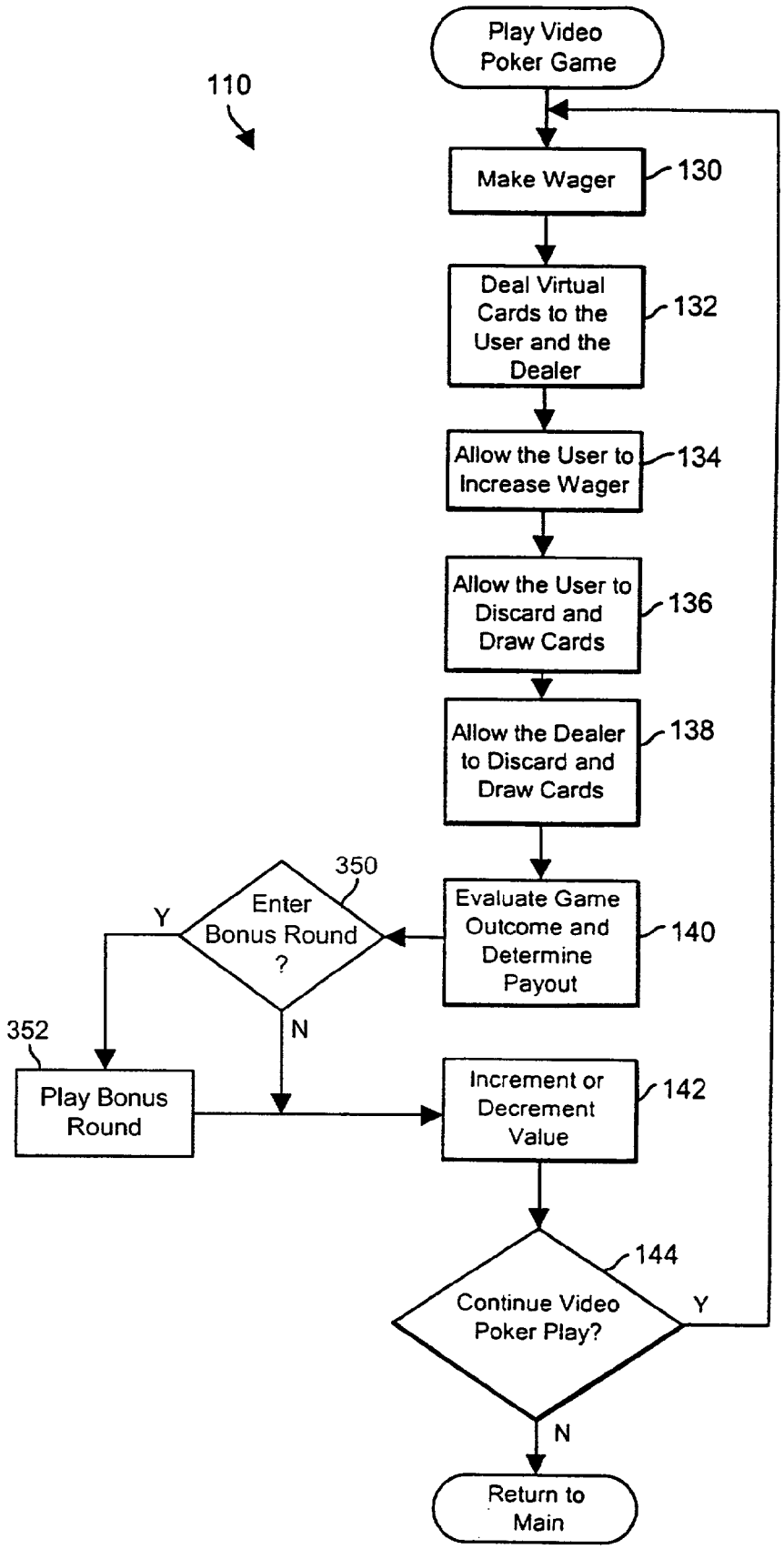
FIG. 5 is an exemplary flow diagram of a play video poker game routine that may be implemented by the controller of FIG. 3.

When the block 108 determines that the user desires to play a video poker game, control passes to the subroutine 110, which is illustrated in detail in FIG. 5. As described hereinafter, the various blocks of the subroutine 110 recite various functions that are carried out by the game controller 70 in conjunction with the display unit 14 to make certain graphics appear on the display unit 14. Exemplary graphics for a video poker game are shown and described in conjunction with FIG. 6.

At a block 130, the subroutine 110 requests the user to make a wager and, after a wager is entered, control passes to a block 132, at which virtual hands of cards are dealt to the user and to the dealer, which is the opponent of the user (e.g., the dealer may be considered to be the game controller 70, which is competing against the user). After the virtual hands have been dealt to the user and the dealer, the user may have an opportunity at the block 134 to increase the initial wager made at the block 130. After the block 134 executes, control passes to a block 136, which allows the user to discard and draw cards in an attempt to improve the user's virtual hand.

After the user has had the opportunity to improve his or her hand at the block 136, control passes to a block 138, at which the dealer has the opportunity to improve its hand by discarding and drawing cards. After the block 138 has completed, control passes to a block 140, at which the game controller 70 determines the outcome of the game and determines the payout. If the user has won the game (e.g., the user's hand is better than the dealer's hand), the payout will be positive. If, however, the user has not won the game, the user may forfeit his wagers made at the block 130 and 134. After the block 140 has determined the outcome, a block 350 queries whether a triggering event has occurred that entitles the user to enter bonus play. If a triggering event occurs, such as the appearance of a Joker or the dealing of a particular combination of cards, control passes to block 352 for execution of bonus play in a manner described more fully below. If no triggering event occurs, or upon completion of bonus play, control passes to a block 142 which increments or decrements the user's value based on the results determined at the block 140 and/or during bonus play.

After the user's value has been incremented or decremented at the block 142, a block 144 queries whether the user desires to continue playing the video poker game. If the user desires to play the video poker game again, control passes from the block 144 back to the block 130, which requests the user to make a wager. If the user does not desire to continue playing the video poker game, execution returns to the block 116 of the routine 100 of FIG. 4.

Figure 6:
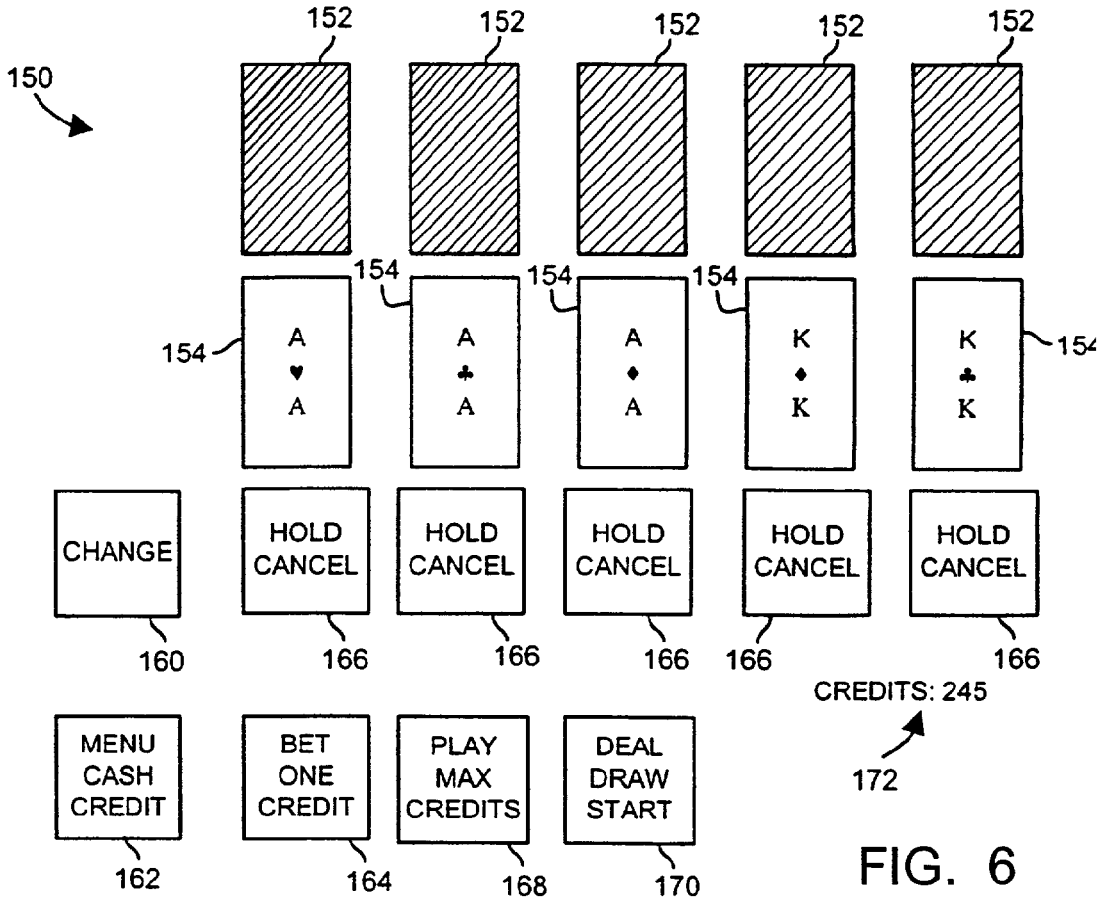
FIG. 6 is an exemplary illustration of graphics that may be displayed on the display unit when the controller of FIG. 3 executes the play video poker game routine of FIG. 5.

As shown in FIG. 6, an exemplary video display 150, which may be associated with the play video poker game routine 110, may include video images representative of a plurality of cards 152 in a dealer's hand, which may be shown face down, and a plurality of cards 154 in a users hand, which may be shown face up. To allow the user to control the play of the video poker game, a plurality of button graphics may be displayed. In particular, button graphics for change 160, menu/cash/credit 162 and bet one credit 164 may be displayed. Further, button graphics for hold/cancel 166 may be displayed, each of which may pertain to a particular one of the user's cards 154. Button graphics for play max credits 168 and deal/draw/start 170 may also be displayed. As noted previously, the touch-sensitive input device may be a touch screen that may be disposed over the display unit 14. Accordingly, each of the button graphics 160–170 may be associated with a particular area of the touch-sensitive input device that is located between the display unit 14 and the user. A graphic representing the number of credits 172 may also be displayed to inform the user of the number of credits that he or she has remaining.

Figure 3:
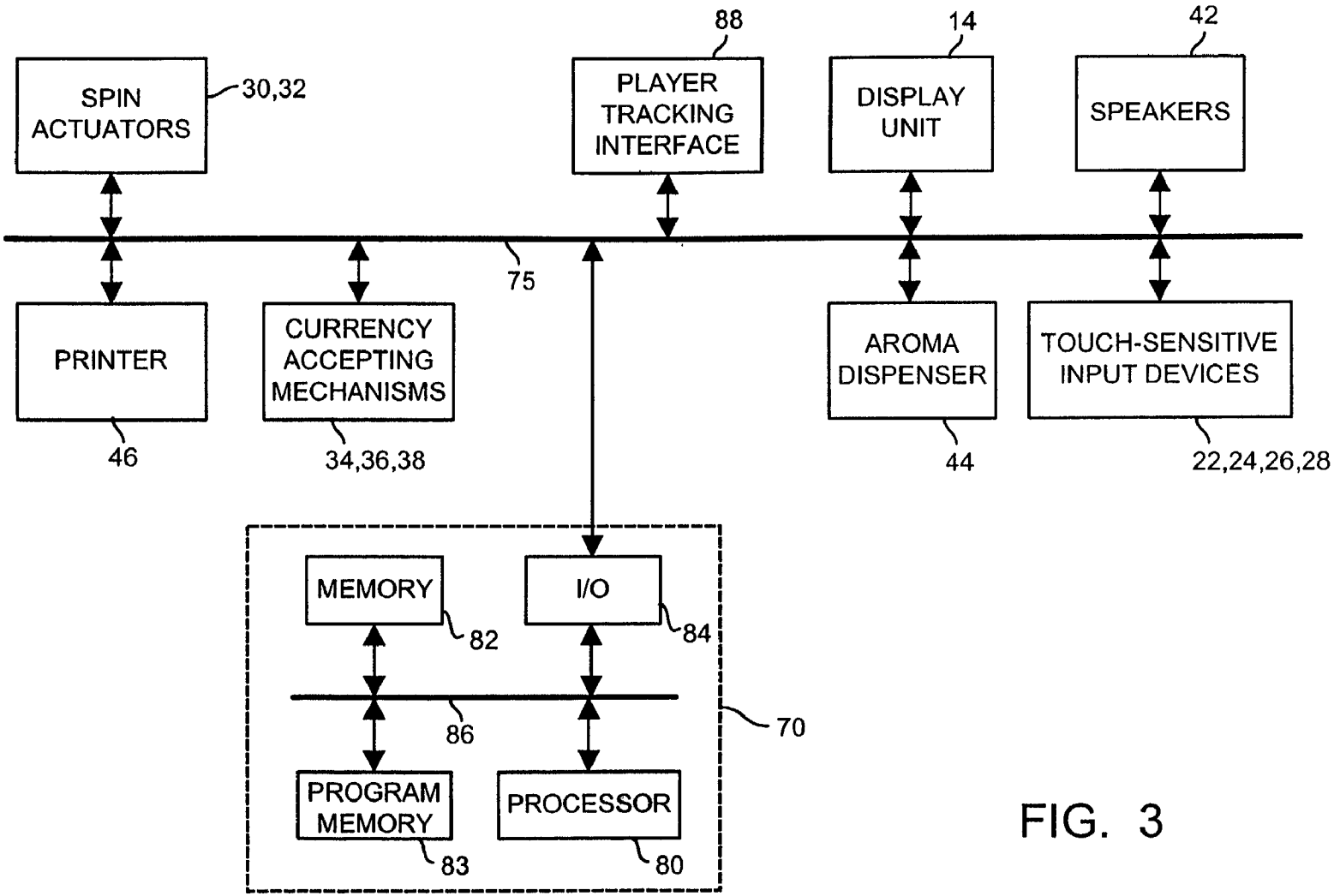
FIG. 3 is an exemplary block diagram of the hardware components of the electronic gambling unit of FIG. 1.
Figure 7:
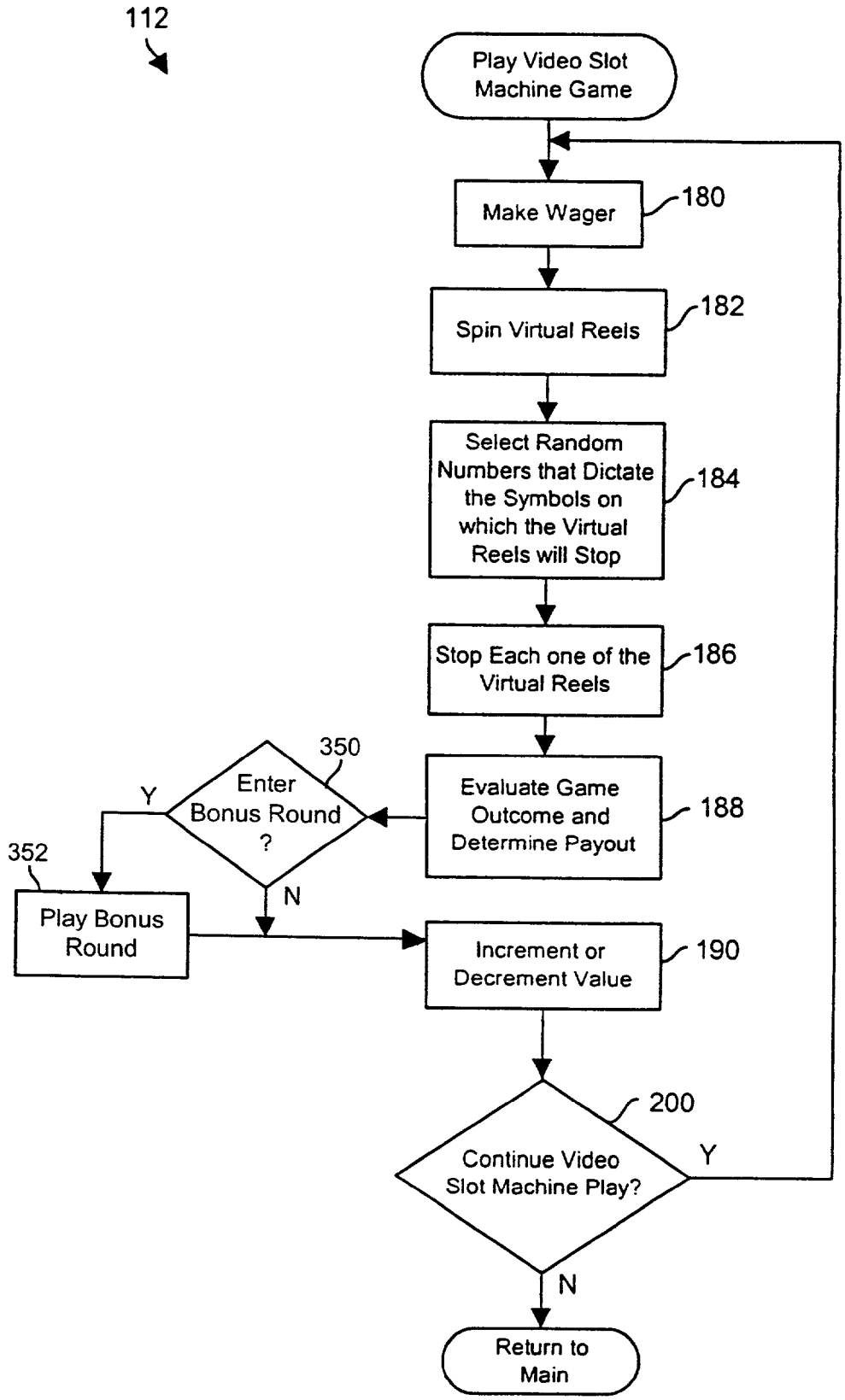
FIG. 7 is an exemplary flow diagram of a play video slot machine routine that may be implemented by the controller of FIG. 3.

When a user desires to play a video slot machine game, a play video slot machine game routine 112, as shown in FIG. 7, is executed. The routine 112 includes a number of blocks that may be embodied in software instructions stored in the memory 82 (FIG. 3). The execution of the routine 112 may begin at a block 180, at which a user may make a wager on the outcome of the video slot machine game. After the user has made an appropriate wager, control passes to a block 182. At the block 182 virtual slot machine reels, which may be embodied in video graphics, begin to spin to simulate the operation of a traditional mechanical slot machine.

While the virtual reels spin, a block 184 may select one or more random numbers that dictate the symbols on which the various virtual reels will stop when the reels cease spinning. Essentially, the block 184 determines the outcome of the video slot machine game. After the block 184 completes, control passes to a block 186, which stops each one of the virtual reels from spinning. The virtual reels may be stopped in a left to right manner, from the perspective of the user, or in any other suitable manner or sequence.

After the virtual reels have been stopped by the block 186, a block 188 evaluates the game outcome and determines the payout to which the user is entitled. For example, if a virtual reels have stopped on high payout symbols, the user may receive a large payout. If, however, the virtual reels have stopped on symbols having no payout, the user loses the money that was wagered at the block 180. After the payout has been determined at the block 188, a block 350 queries whether a triggering event has occurred that entitles the user to enter bonus play. If a triggering event occurs, such as the appearance of a particular combination of symbols on the slot machine wheels, control passes to block 352 for execution of bonus play in a manner described more fully below. If no triggering event occurs, or upon completion of bonus play, control passes to a block 190 which appropriately increments or decrements the value that the user has accumulated within the electronic gambling unit 10 and passes control to a block 200.

The block 200 determines whether the user desires to continue to playing the video slot machine game. If the user desires to play again, control passes from the block 200 back to the block 180. If, however, the user does not desire to play again, control passes to the block 116 of the main routine 100 of FIG. 4.

Figure 8:
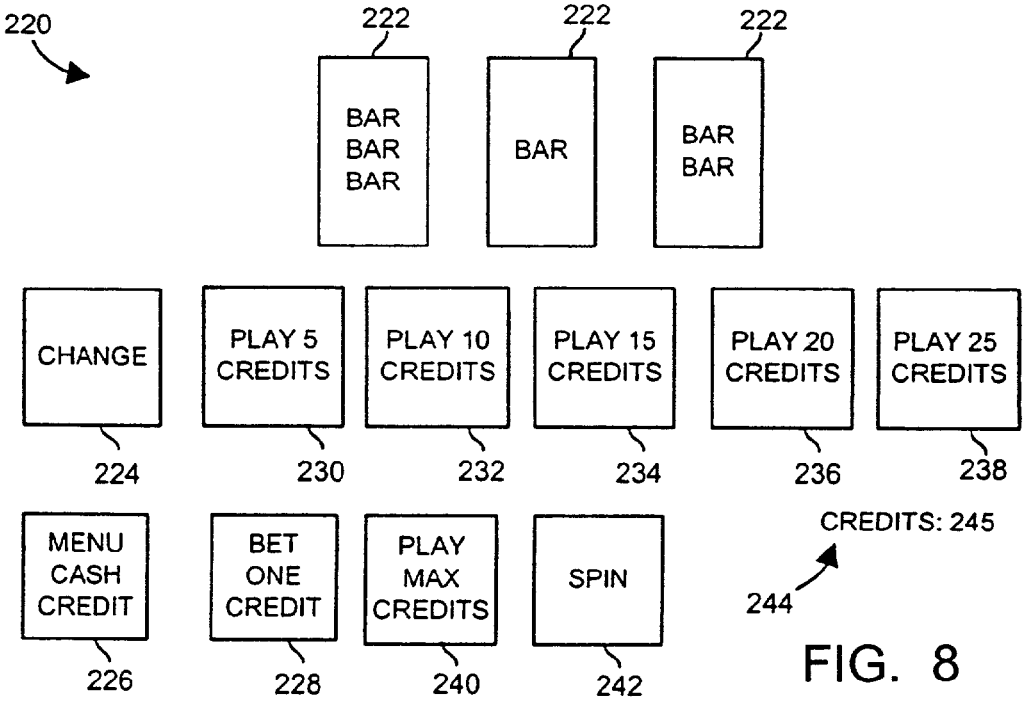
FIG. 8 is an exemplary illustration of graphics that may be displayed on the display unit when the controller of FIG. 3 executes the play video slot machine routine of FIG. 7.

As shown in FIG. 8, an exemplary video display 220, which may be associated with the play video slot machine game routine 112, may include video images that represent a plurality of virtual slot machine reels 222. While three such virtual slot machine reels 222 are shown in FIG. 8, it should be understood that any number of virtual reels could be used. To allow the user to control the play of the video slot machine, a plurality of button graphics may be displayed. In particular, button graphics for change 224, menu/cash/credit 226 and bet one credit 228 may be displayed. Further, button graphics for betting 5, 10, 15, 20 or 25 credits, shown as 230–238 in FIG. 8 may also be provided. Button graphics for play max credits 240 and spin 242 may also be displayed. As noted with respect to FIG. 6, the touch-sensitive input device may be a touch screen that may be disposed over the display unit 14. Accordingly, each of the button graphics 224–242 may be associated with a particular area of the touch-sensitive input device that is located between the display unit 14 and the user. A graphic representing the number of credits 244 may also be displayed to inform the user of the number of credits that he or she has remaining.

Figure 9:
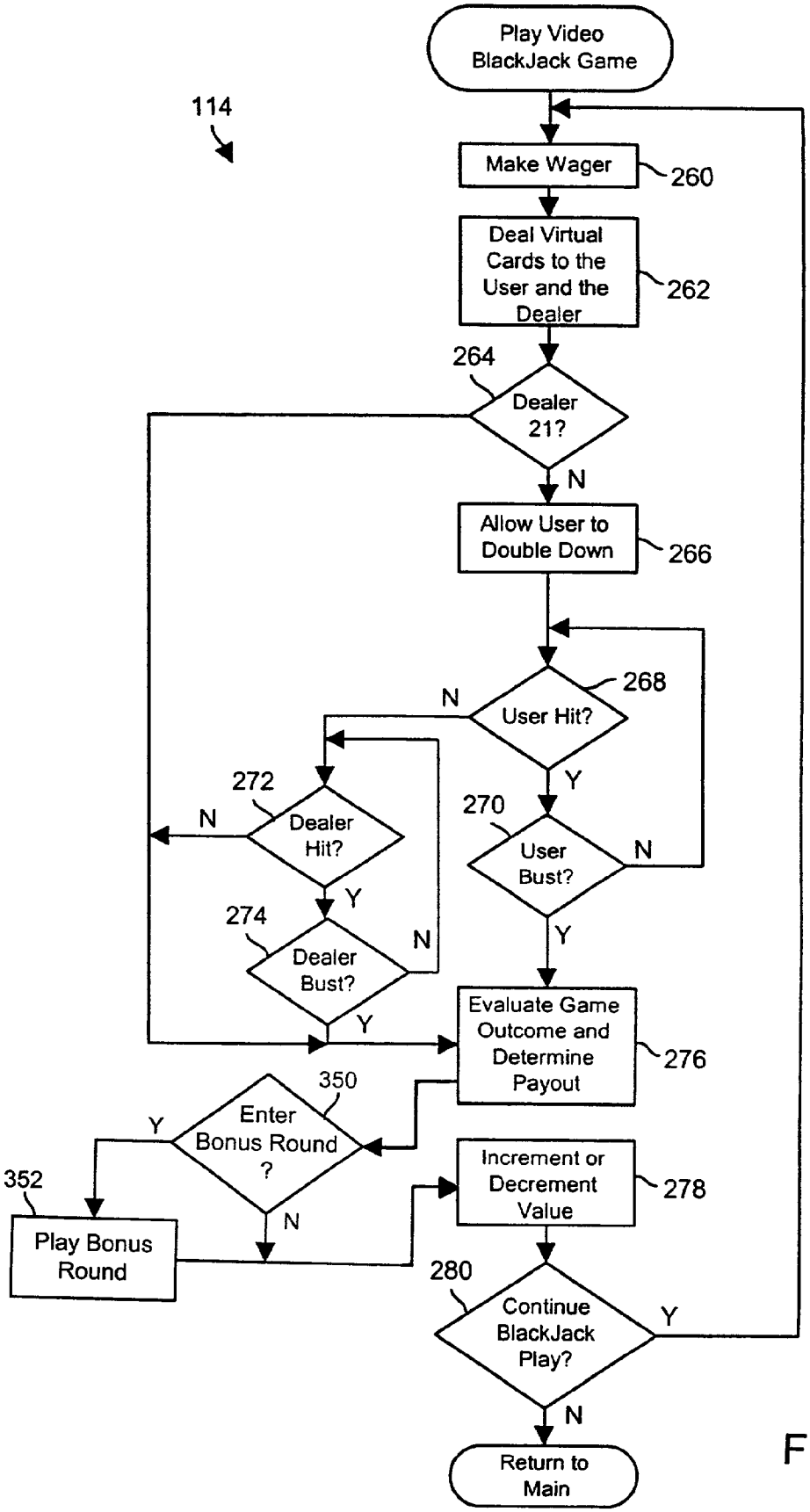
FIG. 9 is an exemplary flow diagram of a play video blackjack game routine that may be implemented by the controller of FIG. 3.

When a user desires to play a video blackjack game, a play video blackjack game routine 114, as shown in FIG. 9, is executed. The routine 114 includes a number of blocks that may be embodied in software instructions stored in the memory 82 (FIG. 3). The execution of the routine 114 may begin at a block 260 at which a user makes a wager on the outcome of the blackjack game. After the user has made a wager, a block 262 deals virtual cards to both of the user and the dealer, against which the user is playing.

After the cards are dealt, a block 264 tests whether the dealer has a hand that totals to 21. If the user does not have 21, control passes to a block 266, at which the user may double down. After the execution of the block 266, a block 268 determines whether the user wants to be "hit" (i.e., be dealt an additional card). If the user is hit, a block 270 determines if the user has "bust" (i.e., has exceeded 21). If the user has not bust, control passes back to the block 268, which allows the user to hit again.

If the user decides not to hit, control passes from the block 268 to a block 272, which determines if the dealer wants to hit. If the dealer hits, control passes to a block 274, which determines if the dealer has bust. If the dealer has not bust, control passes from the block 274 back to the block 272 to provide the dealer another opportunity to hit. If the dealer decides not to hit, control passes to a block 276, which determines the outcome of the blackjack game. For example, the block 276 may determine which of the user or the dealer has the higher hand that does not exceed 21. Additionally, if the user busts at the block 270 or the dealer busts at the block 274 or if the block 264 determines that the dealer has 21, control passes to the block 276. In sum, the block 276 performs the function of evaluating the traditional rules of blackjack and determining the magnitude of the payout that should be paid to the user.

After the block 276 determines the outcome and payout for the game, a block 350 queries whether a triggering event has occurred that entitles the user to enter bonus play. If a triggering event occurs, such as the appearance of a Joker or the dealing of a particular combination of cards, control passes to block 352 for execution of bonus play in a manner described more fully below. If no triggering event occurs, or upon completion of bonus play, control passes to a block 278 which increments or decrements the value of the user based on the payout calculated by the block 276. Upon completion of the block 278, the block 280 determines whether the user desires to play another game of blackjack. If the user desires to play blackjack again, control passes to the block 260. Alternatively, if the user does not desire to play blackjack again, control passes to the block 116 of the main routine 100 of FIG. 4.

Figure 10:
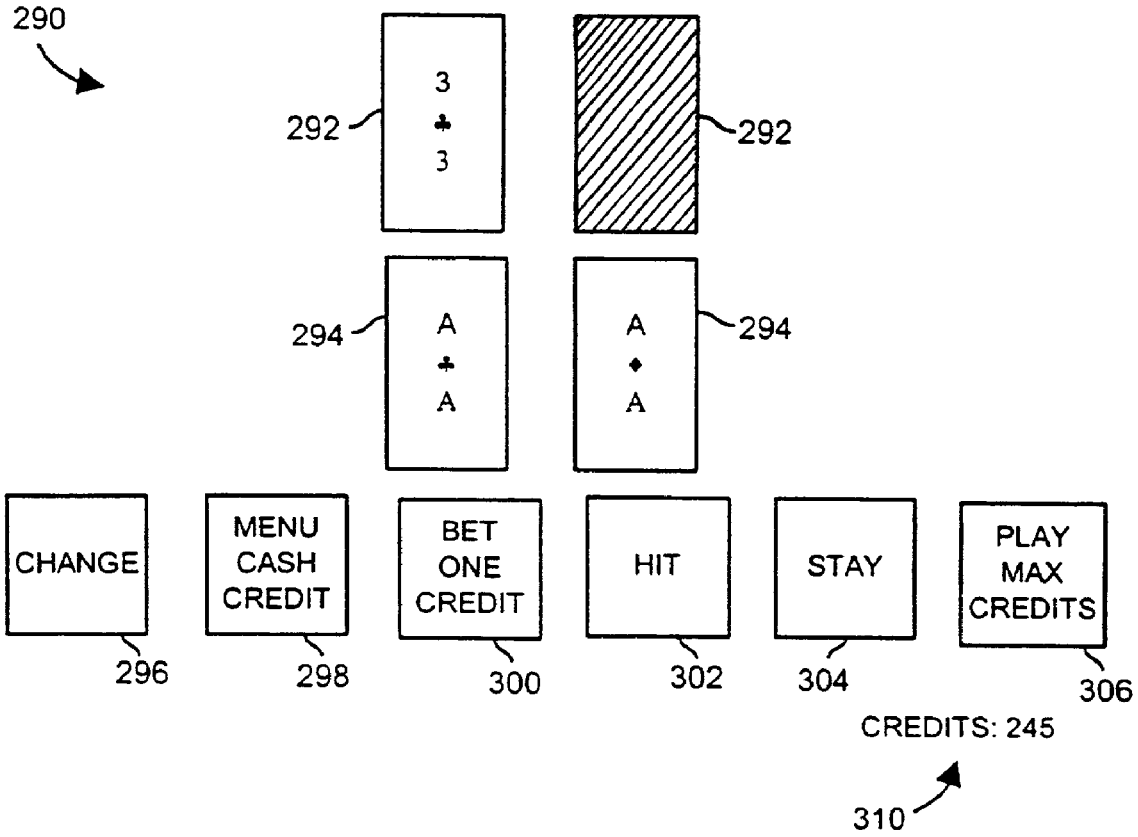
FIG. 10 is an exemplary illustration of graphics that may be displayed on the display unit when the controller of FIG. 3 executes the play video blackjack game routine of FIG. 9.

As shown in FIG. 10, an exemplary video display 290, which may be associated with the play video slot machine game routine 114, may include video images that represent a plurality of cards 292 that form a dealer's hand of cards and a plurality of cards 294 that form the user's hand of cards. To allow the user to control the play of the video blackjack game, a plurality of button graphics may be displayed. In particular, button graphics for change 296, menu/cash/credit 298 and bet one credit 300 may be displayed. Further, button graphics for hit 302, stay 304 and play max credits 306, as shown in FIG. 10 may also be provided. As noted with respect to FIGS. 6 and 8, the touch-sensitive input device may be a touch screen that may be disposed over the display unit 14. Accordingly, each of the button graphics 296–306 may be associated with a particular area of the touch-sensitive input device that is located between the display unit 14 and the user. A graphic representing the number of credits 310 may also be displayed to inform the user of the number of credits that he or she has remaining.

Figure 11:
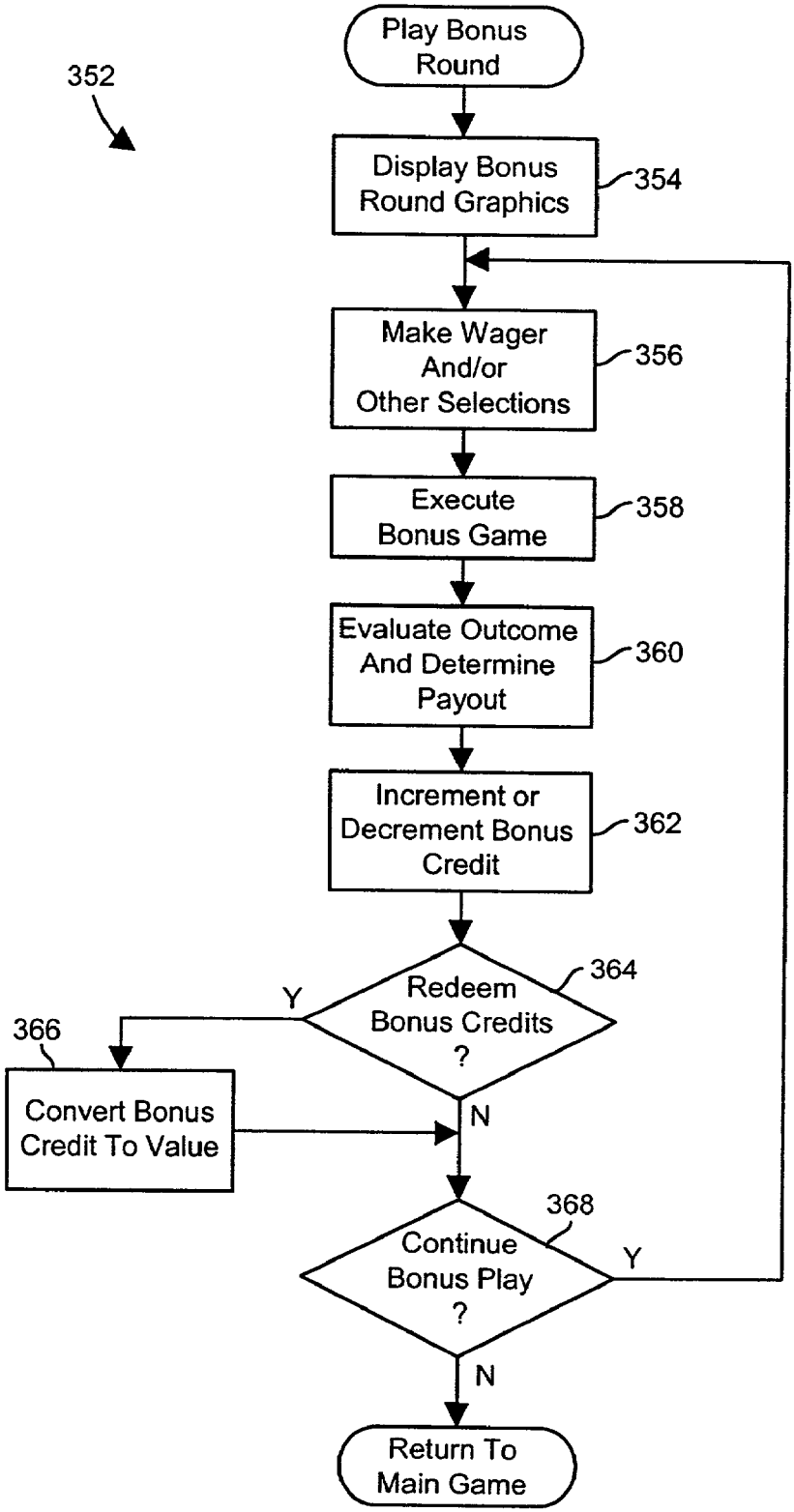
FIG. 11 is an exemplary flow diagram of a bonus round game routine in accordance with the teachings of the present invention that may be implemented by the controller of FIG. 3.

As discussed with respect to FIGS. 5, 7, and 9, the occurrence of a triggering event may entitle the user to play a bonus round. As shown in FIG. 11, the bonus round 352 may begin execution at a block 354 at which bonus game graphics may be displayed on the display unit 14. The bonus round game graphics may include displays of slot machine wheels, dealt playing card configurations, numbers and the like that are appropriate and necessary for the particular bonus round game. The graphics may also include playing instructions for the bonus round game, including actions to be performed by the user such as holding/discarding cards, wagering bonus credits, initiating execution of the bonus round game and the like.

After the block 354 displays the bonus round game graphics, at a block 356, the subroutine 352 allows the user to make a wager of bonus credits and perform any other selections necessary to play the bonus round game. After a wager and/or selections are made by the user, control passes to a block 358, at which the bonus round game subroutine 352 executes the bonus round game. After the block 358 has completed, control passes to a block 360, at which the game controller 70 determines the outcome of the bonus round game and determines the payout. If the user has won the bonus round game, the payout of bonus credits will be positive, and if the user has not won the game, the user may forfeit the bonus credits wagered at the block 356. After the block 360 has determined the outcome, control passes to a block 362, which increments or decrements the user's bonus credits based on the results determined at the block 360.

After the block 362 increments or decrements the user's bonus credits, a block 364 queries whether the accumulated bonus credits, if any, should be paid out to the user. The determination may be based on various information available to the processor 70. For example, the bonus round game may be configured to automatically pay out any accumulated bonus credits after one execution of the bonus round game or once the bonus credits exceed a specified maximum amount. Alternatively, the video display 14 may prompt the user to make specified selections on a touch-sensitive input device to either pay out the bonus credits or continue playing the bonus round game. Still further, the processor 70 may evaluate player profile information from the user's smart card or user profile on the player tracking system to determine whether the user has indicated a preference for receiving a payout of bonus credits, continue playing the bonus round game or to apply the bonus round credits to the normal game play.

If the processor 70 determines that bonus round credits are to be redeemed at block 364, control passes from the block 364 to a block 366, which determines the manner for converting the bonus credits into value. As with the previous determination regarding whether to redeem the bonus credits, the processor 70 at block 366 may use information from various sources to determine the manner or medium for dispensing the bonus credits to the user, including the configuration of the bonus round game, information entered by the user at the touch-sensitive display unit 14, and user profile information from the user's smart card or the player tracking system. Based on the relevant information, the bonus credits may be redeemed by dispensing coins, tokens or currency at the coin tray 40 or bill validator, dispensing tickets or coupons, either pre-printed or printed by the printer 46 and having either a cash value or credit for or toward goods or services available at the gaming establishment, adding cash value or credit to the user's smart card or player tracking profile, or otherwise rewarding the user for bonus credit accumulated during the bonus round game.

After the user's bonus credits have been redeemed at the block 366, or if the processor 70 determines that no bonus credits are to be redeemed at block 364, a block 368 queries whether bonus play will continue either due to the user's election or the configuration of the bonus round game. If the processor 70 determines that bonus round play will continue, control passes from the block 368 to the block 356, which requests the user to make a wager or make other bonus round game selections. If the processor 70 determines that bonus round game play has concluded, execution returns to the appropriate block 142, 190 or 278 of the routines 110, 112 or 114, respectively.

Numerous modifications and alternative embodiments of the invention will be apparent to those skilled in the art in view of the foregoing description. Accordingly, this description is to be construed as illustrative only and not as limiting to the scope of the invention. The details of the structure may be varied substantially without departing from the spirit of the invention, and the exclusive use of all modifications, which are within the scope of the appended claims, is reserved.

What is claimed is:

1. An electronic gambling unit for allowing a user to play a main gambling game and a bonus round game, and for dispensing value to the user at the conclusion of the bonus round game, the electronic gambling unit comprising:

a display unit capable of generating color images associated with the main gambling game and the bonus round game;

an input device that allows the user to make a plurality of input selections;

a currency-accepting mechanism that is capable of allowing the user to deposit a medium of currency;

a value-dispensing mechanism that is capable of dispensing value to the user; and a controller operatively coupled to the display unit, the input device, the currency-accepting mechanism, and the value-dispensing mechanism, the controller comprising a processor and a memory operatively coupled to the processor, the controller being programmed to allow the user to make a wager via the input device after the currency-accepting mechanism detects deposit of currency by the user;

the controller being programmed to cause the display unit to display a first sequence of images representing the main gambling game after the user makes a wager, the first sequence of images representing a main gambling game selected from the group of video gambling games consisting of video poker, video slots, video blackjack, video keno and video bingo, at least one of the images comprising an image of at least five playing cards if the video gambling game is video poker, at least one of the images comprising an image of a plurality of simulated slot machine reels if the video gambling game is video slots, at least one of the images comprising an image of a plurality of playing cards if the video gambling game is video blackjack, at least one of the images comprising an image of a bingo grid if the video gambling game is bingo, and at least one of the images comprising an image of a keno grid if the video gambling game is keno, the controller being programmed to determine, after the first sequence of images has been displayed, an outcome of the main gambling game represented by the first sequence of images and to determine a currency payout associated with the outcome of the main gambling game, the controller being programmed to determine the occurrence of a triggering event during execution of the main gambling game, the controller being programmed to cause a second sequence of images to be generated on the display after detecting the triggering event, the second sequence of images representing the bonus round game, the controller being programmed to determine, after the second sequence of images has been displayed, an outcome of the bonus round game represented by the second sequence of images and to determine a bonus payout associated with the outcome of the bonus round game, the controller being programmed to cause the value-dispensing mechanism to dispense the bonus payout and not the currency payout to the user after the bonus payout has been determined in response to detecting a bonus payout dispensing selection by the user at the electronic gambling unit, and to add the bonus payout to the available credits for the user at the gambling unit in response to not detecting the bonus payout dispensing selection, and the controller being programmed to return to the main gambling game at the conclusion of the bonus round game.

2. The electronic gambling unit of claim 1, wherein the currency-accepting mechanism comprises one of a coin slot, a bill reader, and an electronic reader that is capable of reading an item having data stored thereon.

3. The electronic gambling unit of claim 1, wherein the currency-accepting mechanism comprises an electronic reader that is capable of reading an item having data stored thereon, and the controller is programmed to cause the value-dispensing mechanism to dispense the bonus payout after the bonus payout has been determined based on user preference information corresponding to the data stored on the item.

4. The electronic gambling unit of claim 3, further comprising an interface connecting the electronic gambling unit to a player tracking system, wherein the controller is programmed to transmit data stored on the item to the player tracking system via the interface, to receive user preference information related to the user associated with the item having date stored thereon from the player tracking system via the interface, and to cause the value-dispensing mechanism to dispense the bonus payout after the bonus payout has been determined based on the user preference information received from the player tracking system.

5. The electronic gambling unit of claim 1, wherein the controller is programmed to cause the value-dispensing mechanism to dispense the bonus payout after the bonus payout has been determined based on user preference information entered by the user via the input device.

6. The electronic gambling unit of claim 1, wherein the value-dispensing mechanism is a printing apparatus and the dispensed value is an award ticket printed and dispensed by the printing apparatus and having indicia of at least one of a casino name, a ticket type, a validation number, a bar code, a date of issuance, a time of issuance, redemption instructions, redemption restrictions, and a description of the award.

7. The electronic gambling unit of claim 1, wherein the triggering event is the appearance in the first sequence of images of one of a combination of symbols and a bonus game symbol.

8. The electronic gambling unit of claim 1, wherein the value dispensed by the value-dispensing mechanism is at least one of paper currency, coins, tokens, gaming machine credit, a ticket redeemable for cash, a ticket for a show, a ticket for a meal, a ticket for casino services, a ticket for hotel services, incrementing credit stored on a smart card, and incrementing credit stored in a player tracking system.

9. An electronic gambling unit for allowing a user to play a main gambling game and a bonus round game, and for dispensing value to the user at the conclusion of the bonus round game, the electronic gambling unit comprising:

a display unit capable of generating color images;

an input device that allows the user to make a plurality of input selections;

a currency-accepting mechanism that is capable of allowing the user to deposit a medium of currency;

a value-dispensing mechanism that is capable of dispensing value to the user; and a controller operatively coupled to the display unit, the input device, the currency-accepting mechanism, and the value-dispensing mechanism, the controller comprising a processor and a memory operatively coupled to the processor, the controller being programmed to execute the main gambling game, the controller being programmed to cause the display unit to display a first sequence of images representing the main gambling game, the first sequence of images representing a main gambling game selected from the group of video gambling games consisting of video poker, video slots, video blackjack, video keno and video bingo, at least one of the images comprising an image of at least five playing cards if the video gambling game is video poker, at least one of the images comprising an image of a plurality of simulated slot machine reels if the video gambling game is video slots, at least one of the images comprising an image of a plurality of playing cards if the video gambling game is video blackjack, at least one of the images comprising an image of a bingo grid if the video gambling game is bingo, and at least one of the images comprising an image of a keno grid if the video gambling game is keno, the controller being programmed to determine, after executing the main gambling game, an outcome of the main gambling game and to determine a currency payout associated with the outcome of the main gambling game, the controller being programmed to determine the occurrence of a triggering event during execution of the main gambling game, the controller being programmed to execute the bonus round game after detecting the triggering event, the controller being programmed to determine, after the execution of the bonus round game, an outcome of the bonus round game and to determine a bonus payout associated with the outcome of the bonus round game, the controller being programmed to cause the value-dispensing mechanism to dispense the bonus payout and not the currency payout to the user after the bonus payout has been determined in response to detecting a bonus payout dispensing selection by the user at the electronic gambling unit, and to add the bonus payout to the available credits for the user at the gambling unit in response to not detecting the bonus payout dispensing selection, and the controller being programmed to return to executing the main gambling game at the conclusion of the bonus round game.

10. The electronic gambling unit of claim 9, wherein the currency-accepting mechanism comprises one of a coin slot, a bill reader, and an electronic reader that is capable of reading an item having data stored thereon.

11. The electronic gambling unit of claim 9, wherein the currency-accepting mechanism comprises an electronic reader that is capable of reading an item having data stored thereon, and the controller is programmed to cause the value-dispensing mechanism to dispense the bonus payout after the bonus payout has been determined based on user preference information corresponding to the data stored on the item.

12. The electronic gambling unit of claim 11, further comprising an interface connecting the electronic gambling unit to a player tracking system, wherein the controller is programmed to transmit data stored on the item to the player tracking system via the interface, to receive user preference information related to the user associated with the item having date stored thereon from the player tracking system via the interface and to cause the value-dispensing mechanism to disp use the bonus payout after the bonus payout has been determined based on the user preference information received from the player tracking system.

13. The electronic gambling unit of claim 9, wherein the controller is programmed to cause the value-dispensing mechanism to dispense the bonus payout after the bonus payout has been determined based on user preference information entered by the user via the input device.

14. The electronic gambling unit of claim 9, wherein the value-dispensing mechanism is a printing apparatus and the dispensed value is an award ticket printed and dispensed by the printing apparatus and having indicia of at least one of a casino name, a ticket type, a validation number, a bar code, a date of issuance, a time of issuance, redemption instructions, redemption restrictions, and a description of the award.

15. The electronic gambling unit of claim 9, wherein the triggering event is the appearance in the first sequence of images of one of a combination of symbols and a bonus game symbol.

16. The electronic gambling unit of claim 9, wherein the value dispensed by the value-dispensing mechanism is at least one of paper currency, coins, tokens, gaming machine credit, a ticket redeemable for cash, a ticket for a show, a ticket for a meal, a ticket for casino services, a ticket for hotel services, incrementing credit stored on a smart card, and incrementing credit stored in a player tracking system.

17. An electronic gambling unit for allowing a user to play a main gambling game and a bonus round game, and for dispensing value to the user at the conclusion of the bonus round game, the electronic gambling unit comprising:

a display mechanism capable of capable of displaying symbols associated with the main gambling game and the bonus round game;

an input device that allows the user to make a plurality of input selections;

a currency-accepting mechanism that is capable of allowing the user to deposit a medium of currency;

a value-dispensing mechanism that is capable of dispensing value to the user; and a controller operatively coupled to the display mechanism, the input device, the currency-accepting mechanism, and the value-dispensing mechanism, the controller comprising a processor and a memory operatively coupled to the processor, the controller being programmed to allow the user to make a wager via the input device after the currency-accepting mechanism detects deposit of currency by the user;

the controller being programmed to cause the display mechanism to display a first sequence of symbols representing the main gambling game after the user makes a wager, the controller being programmed to determine, after the first sequence of symbols has been displayed, an outcome of the main gambling game represented by the first sequence of symbols and to determine a currency payout associated with the outcome of the main gambling game, the controller being programmed to determine the occurrence of a triggering event during execution of the main gambling game, the controller being programmed to cause a second sequence of symbols to be generated on the display after detecting the triggering event, the second sequence of symbols representing the bonus round game, the controller being programmed to determine, after the second sequence of symbols has been displayed, an outcome of the bonus round game represented by the second sequence of symbols and to determine a bonus payout associated with the outcome of the bonus round game, the controller being programmed to cause the value-dispensing mechanism to dispense the bonus payout and not the currency payout to the user after the bonus payout has been determined in response to detecting a bonus payout dispensing selection by the user at the electronic gambling unit, and to add the bonus payout to the available credits for the user at the gambling unit in response to not detecting the bonus payout dispensing selection, and the controller being programmed to return to the main gambling game at the conclusion of the bonus round game.

18. The electronic gambling unit of claim 17, wherein the currency-accepting mechanism comprises one of a coin slot, a bill reader, and an electronic reader that is capable of reading an item having data stored thereon.

19. The electronic gambling unit of claim 17, wherein the currency-accepting mechanism comprises an electronic reader that is capable of reading an item having data stored thereon, and the controller is programmed to cause the value-dispensing mechanism to dispense the bonus payout after the bonus payout has been determined based on user preference information corresponding to the data stored on the item.

20. The electronic gambling unit of claim 19, further comprising an interface connecting the electronic gambling unit to a player tracking system, wherein the controller is programmed to transmit data stored on the item to the player tracking system via the interface, to receive user preference information related to the user associated with the item having date stored thereon from the player tracking system via the interface, and to cause the value-dispensing mechanism to dispense the bonus payout after the bonus payout has been determined based on the user preference information received from the player tracking system.

21. The electronic gambling unit of claim 17, wherein the controller is programmed to cause the value-dispensing mechanism to dispense the bonus payout after the bonus payout has been determined based on user preference information entered by the user via the input device.

22. The electronic gambling unit of claim 17, wherein the value-dispensing mechanism is a printing apparatus and the dispensed value is an award ticket printed and dispensed by the printing apparatus and having indicia of at least one of a casino name, a ticket type, a validation number, a bar code, a date of issuance, a time of issuance, redemption instructions, redemption restrictions, and a description of the award.

23. The electronic gambling unit of claim 17, wherein the triggering event is the appearance in the first sequence of symbols of one of a combination of symbols and a bonus game symbol.

24. The electronic gambling unit of claim 17, wherein the value dispensed by the value-dispensing mechanism is at least one of paper currency, coins, tokens, gaming machine credit, a ticket redeemable for cash, a ticket for a show, a ticket for a meal, a ticket for casino services, a ticket for hotel services, incrementing credit stored on a smart card, and incrementing credit stored in a player tracking system.

25. An electronic gambling unit for allowing a user to play a main gambling game and a bonus round game, and for dispensing value to the user at the conclusion of the bonus round game, the electronic gambling unit comprising:

an input device that allows the user to make a plurality of input selections;

a currency-accepting mechanism that is capable of allowing the user to deposit a medium of currency;

a value-dispensing mechanism that is capable of dispensing value to the user; and a controller operatively coupled to the input device, the currency-accepting mechanism, and the value-dispensing mechanism, the controller comprising a processor and a memory operatively coupled to the processor, the controller being programmed to execute the main gambling game, the controller being programmed to determine, after executing the main gambling game, an outcome of the main gambling game and to determine a currency payout associated with the outcome of the main gambling game, the controller being programmed to determine the occurrence of a triggering event during execution of the main gambling game, the controller being programmed to execute the bonus round game after detecting the triggering event, the controller being programmed to determine, after the execution of the bonus round game, an outcome of the bonus round game and to determine a bonus payout associated with the outcome of the bonus round game, the controller being programmed to cause the value-dispensing mechanism to dispense the bonus payout and not the currency payout to the user the bonus payout has been determined in response to detecting a bonus payout dispensing selection by the user at the electronic gambling unit, and to add the bonus payout to the available credits for the user at the gambling unit in response to not detecting the bonus payout dispensing selection, and the controller being programmed to return to executing the main gambling game at the conclusion of the bonus round game.

26. The electronic gambling unit of claim 25, wherein the currency-accepting mechanism comprises one of a coin slot, a bill reader, and an electronic reader that is capable of reading an item having data stored thereon.

27. The electronic gambling unit of claim 25, wherein the currency-accepting mechanism comprises an electronic reader that is capable of reading an item having data stored thereon, and the controller is programmed to cause the value-dispensing mechanism to dispense the bonus payout after the bonus payout has been determined based on user preference information corresponding to the data stored on the item.

28. The electronic gambling unit of claim 27, further comprising an interface connecting the electronic gambling unit to a player tracking system, wherein the controller is programmed to transmit data stored on the item to the player tracking system via the interface, to receive user preference information related to the user associated with the item having date stored thereon from the player tracking system via the interface, and to cause the value-dispensing mechanism to dispense the bonus payout after the bonus payout has been determined based on the user preference information received from the player tracking system.

29. The electronic gambling unit of claim 25, wherein the controller is programmed to cause the value-dispensing mechanism to dispense the bonus payout after the bonus payout has been determined based on user preference information entered by the user via the input device.

30. The electronic gambling unit of claim 25, wherein the value-dispensing mechanism is a printing apparatus and the dispensed value is an award ticket printed and dispensed by the printing apparatus and having indicia of at least one of a casino name, a ticket type, a validation number, a bar code, a date of issuance, a time of issuance, redemption instructions, redemption restrictions, and a description of the award.

31. The electronic gambling unit of claim 25, further comprising a display mechanism capable of displaying symbols associated with the main gambling game and the bonus round game, wherein the controller is operatively coupled to the display mechanism and programmed to cause the display mechanism to display a first sequence of symbols representing the main gambling game, and wherein the triggering event is the appearance in the first sequence of symbols of one of a combination of symbols and a bonus game symbol.

32. The electronic gambling unit of claim 25, wherein the value dispensed by the value-dispensing mechanism is at least one of paper currency, coins, tokens, gaming machine credit, a ticket redeemable for cash, a ticket for a show, a ticket for a meal, a ticket for casino services, a ticket for hotel services, incrementing credit stored on a smart card, and incrementing credit stored in a player tracking system.

33. A method of dispensing bonus awards to a user at the conclusion of a bonus round game of an electronic gambling unit that allows the user to play a main gambling game and a bonus round game, the method comprising:

executing the main gambling game;

determining, after execution of the main gambling game, an outcome of the main gambling game, and a currency payout associated with the outcome of the main gambling game;

detecting the occurrence of a triggering event during execution of the main gambling game;

executing the bonus round game after detecting the triggering event;

determining, after execution of the bonus round game, an outcome of the bonus round game, and a bonus payout associated with the outcome of the bonus round game;

detecting a bonus payout dispensing selection by the user;

dispensing the bonus payout and not the currency payout to the user via a value-dispensing mechanism after determining the bonus payout in response to detecting the bonus payout dispensing selection;

adding the bonus payout to the available credits for the user at the gambling unit in response to not detecting the bonus payout dispensing selection; and returning to execution of the main gambling game at the conclusion of the bonus round game.

34. The method of claim 33, comprising accepting currency in one of a coin slot, a bill reader, and an electronic reader that is capable of reading an item having data stored thereon.

35. The method of claim 33, comprising:

accepting currency in an electronic reader capable of reading an item having data stored thereon; and dispensing the bonus payout after the bonus payout is determined based on user preference information corresponding to the data stored on the item.

36. The method of claim 35, further comprising:

transmitting data stored on the item to a player tracking system via an interface;

receiving user preference information related to the user associated with the item having date stored thereon from the player tracking system via the interface; and dispensing the bonus payout after the bonus payout has been determined based on user preference information received from the player tracking system.

37. The method of claim 33, comprising dispensing the bonus payout after the bonus payout has been determined based on user preference information entered by the user via the input device.

38. The method of claim 33, comprising dispensing value as an award ticket printed and dispensed by a printing apparatus and having indicia of at least one of a casino name, a ticket type, a validation number, a bar code, a date of issuance, a time of issuance, redemption instructions, redemption restrictions, and a description of the award.

39. The method of claim 33, further comprising:

displaying a first sequence of symbols representing the main gamblirg game on a display mechanism; and detecting the triggering event based on the appearance in the first sequence of symbols of one of a combination of symbols and a bonus game symbol.

40. The method of claim 33, comprising dispensing value to the user after determining the bonus payout as at least one of paper currency, coins, tokens, gaming machine credit, a ticket redeemable for cash, a ticket for a show, a ticket for a meal, a ticket for casino services, a ticket for hotel services, incrementing credit stored on a smart card, and incrementing credit stored in a player tracking system.

41. A programmed memory that is capable of being used in connection with an electronic gambling unit that allows a user to play a main gambling game and a bonus round game, that dispenses value to the user at the conclusion of the bonus round game, and that comprises a processor, an input device, a currency-accepting mechanism, and a value-dispensing mechanism, the programmed memory comprising:

a first memory portion physically configured in accordance with computer program instructions that would cause the electronic gambling unit to execute the main gambling game if the programmed memory were incorporated into the electronic gambling unit;

a second memory portion physically configured in accordance with computer program instructions that would cause said electronic gambling unit to determine an outcome of the main gambling game if the programmed memory were incorporated into the electronic gambling unit;

a third memory portion physically configured in accordance with computer program instructions that would cause said electronic gambling unit to determine the occurrence of a triggering event during execution of the main gambling game if the programmed memory were incorporated into the electronic gambling unit;

a fourth memory portion physically configured in accordance with computer program instructions that would cause said electronic gambling unit to execute the bonus round game after detecting the triggering event if the programmed memory were incorporated into the electronic gambling unit;

a fifth memory portion physically configured in accordance with computer program instructions that would cause said electronic gambling unit to determine an outcome of the bonus round game if the programmed memory were incorporated into the electronic gambling unit;

a sixth memory portion physically configured in accordance with computer program instructions that would cause said electronic gambling unit to determine a bonus payout associated with the outcome of the bonus round game if the programmed memory were incorporated into the electronic gambling unit;

a seventh memory portion physically configured in accordance with computer program instructions that would cause said electronic gambling unit to cause the value-dispensing mechanism to dispense the bonus payout and not the currency payout to the user after the bonus payout has been determined in response to detecting a bonus payout dispensing selection by the user at the electronic gambling unit, and to add the bonus payout to the available credits for the user at the gambling unit in response to not detecting the bonus payout dispensing selection after the bonus game is completed, if the programmed memory were incorporated into the electronic gambling unit; and an eighth memory portion physically configured in accordance with computer program instructions that would cause said electronic gambling unit to return to executing the main gambling game at the conclusion of the bonus round if the programmed memory were incorporated into the electronic gambling unit.

42. The programmed memory of claim 41, wherein the currency-accepting mechanism is an electronic reader that is capable of reading an item having data stored thereon, and the programmed memory further comprises a ninth memory portion physically configured in accordance with computer program instructions that would cause the value-dispensing mechanism to dispense the bonus payout after the bonus payout has been determined based on user preference information corresponding to the data stored on the item if the programmed memory were incorporated into the electronic gambling unit.

43. The programmed memory of claim 42, wherein an interface connects the electronic gambling unit to a player tracking system, the programmed memory further comprising:

a tenth memory portion physically configured in accordance witL computer program instructions that would cause the electronic gambling unit to transmit data stored on the item to the player tracking system via the interface if the programmed memory were incorporated into the electronic gambling unit;

an eleventh memory portion physically configured in accordance with computer program instructions that would cause the electronic gambling unit to receive user preference information related to the user associated with the item having date stored thereon from the player tracking system via the interface if the programmed memory were incorporated into the electronic gambling unit; and a twelfth memory portion physically configured in accordance with computer program instructions that would cause the value-dispensing mechanism to dispense the bonus payout after the bonus payout has been determined based on the user preference information received from the player tracking system if the programmed memory were incorporated into the electronic gambling unit.

44. The programmed memory of claim 41, further comprising a ninth memory portion physically configured in accordance with computer program instructions that would cause the value-dispensing mechanism to dispense the bonus payout after the bonus payout has been determined based on the user preference information entered by the user via the input device if the programmed memory were incorporated into the electronic gambling unit.

45. The programmed memory of claim 41, wherein the value-dispensing mechanism is a printing apparatus and the dispensed value is an award ticket, the programmed memory further comprising a ninth memory portion physically configured in accordance with computer program instructions that would cause the printing apparatus to print and dispense award tickets having indicia of at least one of a casino name, a ticket type, a validation number, a bar code, a date of issuance, a time of issuance, redemption instructions, redemption restrictions, and a description of the award if the programmed memory were incorporated into the electronic gambling unit.

46. The programmed memory of claim 41, wherein the electronic gambling unit further comprises a display mechanism capable of displaying symbols associated with the main gambling game and the bonus round game, the programmed memory further comprising:

a ninth memory portion physically configured in accordance with computer program instructions that would cause the display mechanism to display a first sequence of symbols representing the main gambling game if the programmed memory were incorporated into the electronic gambling unit; and a tenth memory portion physically configured in accordance with computer program instructions that would cause the electronic gambling unit to determine the occurrence of the triggering event based on the appearance in the first sequence of symbols of one of a combination of symbols and a bonus game symbol if the programmed memory were incorporated into the electronic gambling unit.

47. The programmed memory of claim 41, further comprising a ninth memory portion physically configured in accordance with computer program instructions that would cause the value-dispensing mechanism to dispense at least one of paper currency, coins, tokens, gaming machine credit, a ticket redeemable for cash, a ticket for a show, a ticket for a meal, a ticket for casino services, a ticket for hotel services, incrementing credit stored on a smart card, and incrementing credit stored in a player tracking system if the programmed memory were incorporated into the electronic gambling unit.

48. The programmed memory of claim 41, wherein the programmed memory comprises a semi-conductor memory.

49. The programmed memory of claim 41, wherein the programmed memory comprises an optically-readable memory.

50. A method of dispensing bonus awards to a user at the conclusion of a bonus round game of an electronic gambling unit that allows the user to play a main gambling game and a bonus round game, the method comprising:

executing the main gambling game;

determining, after execution of the main gambling game, an outcome of the main gambling game, and a currency payout associated with the outcome of the main gambling game;

detecting the occurrence of a triggering event during execution of the main gambling game;

executing the bonus round game after detecting the triggering event, wherein entry into the bonus round game is independent of the amount wagered;

determining, after execution of the bonus round game, an outcome of the bonus round game, and a bonus payout associated with the outcome of the bonus round game;

dispensing the bonus payout and not the currency payout to the user via a value-dispensing mechanism after determining the bonus payout and prior to returning to the main gambling game if the user inputs an immediate bonus payout selection; and returning to execution of the main gambling game at the conclusion of the bonus round game.

51. The method of claim 50, comprising:

accepting currency in an electronic reader capable of reading an item having data stored thereon; and dispensing the bonus payout after the bonus payout is determined based on user preference information corresponding to the data stored on the item.

52. The method of claim 51, further comprising:

transmitting data stored on the item to a player tracking system via an interface;

receiving user preference information related to the user associated with the item having data stored thereon from the player tracking system via the interface; and dispensing the bonus payout after the bonus payout has been determined based on user preference information received from the player tracking system.

53. The method of claim 50, comprising dispensing the bonus payout after the bonus payout has been determined based on user preference information entered by the user via the input device.

54. The method of claim 50, comprising dispensing value as an award ticket printed and dispensed by a printing apparatus and having indicia of at least one of a casino name, a ticket type, a validation number, a bar code, a date of issuance, a time of issuance, redemption instruction, redemption restrictions, and a description of the award.

* * * * *